US007578274B2

(12) United States Patent
Kleiber et al.

(10) Patent No.: US 7,578,274 B2
(45) Date of Patent: Aug. 25, 2009

(54) CAMSHAFT ADJUSTER

(75) Inventors: Thomas Kleiber, Herzogenaurach (DE); Wolfram Kruhoffer, Aurachtal (DE)

(73) Assignee: Schaeffler KG, Herzogenaurach (DE)

( * ) Notice: Subject to any disclaimer, the term of this patent is extended or adjusted under 35 U.S.C. 154(b) by 52 days.

(21) Appl. No.: 11/913,572

(22) PCT Filed: Apr. 5, 2006

(86) PCT No.: PCT/EP2006/003065

§ 371 (c)(1),
(2), (4) Date: Nov. 5, 2007

(87) PCT Pub. No.: WO2006/117049

PCT Pub. Date: Nov. 9, 2006

(65) Prior Publication Data

US 2008/0190388 A1 Aug. 14, 2008

(30) Foreign Application Priority Data

May 3, 2005 (DE) ..... 10 2005 020 529

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 6,651,600 B1 * 11/2003 Schafer et al. ..... 123/90.17
2001/0054405 A1 12/2001 Miyasaka
2003/0037741 A1 2/2003 Kohrs

FOREIGN PATENT DOCUMENTS

| | | |
|---|---|---|
| DE | 19623818 | 12/1996 |
| DE | 19541769 | 5/1997 |
| DE | 19755497 | 7/1997 |
| DE | 19630662 | 2/1998 |
| DE | 19700866 | 7/1998 |
| DE | 19716203 | 10/1998 |
| DE | 19723945 | 10/1998 |
| DE | 19724989 | 12/1998 |
| DE | 10039923 | 3/2001 |
| DE | 19961193 | 6/2001 |
| DE | 10031974 | 1/2002 |
| DE | 10036546 | 2/2002 |
| DE | 19983890 | 3/2002 |
| DE | 10055334 | 10/2003 |
| WO | 0102703 | 1/2001 |
| WO | 03076711 | 9/2003 |

* cited by examiner

*Primary Examiner*—Ching Chang
(74) *Attorney, Agent, or Firm*—Volpe and Koenig, P.C.

(57) ABSTRACT

A locking unit of a camshaft adjuster (1) for an internal combustion engine is provided, in which a locking pin (19) establishes a positive connection between a driving element and a driven element of the camshaft adjuster (1). The driving element and/or the driven element are formed by a plastic part. An insert (26) against which the locking pin (19) rests and which is supported relative to the plastic part in the area of an inner and outer contour is inserted into the plastic part. Providing large area support of the contours makes it possible to use plastic as a material in spite of the great stress that occurs, particular attention being paid to a good introduction of force into the plastic part.

9 Claims, 6 Drawing Sheets

CAMSHAFT ADJUSTER

BACKGROUND

The invention relates to a camshaft adjuster for an internal combustion engine. Such camshaft adjusters are used to adjust the relative angular position between a driving element, such as a driving wheel, which is in driven connection with a crankshaft of the internal combustion engine via traction element, such as a chain or a belt, and a driven element driving a camshaft. In this way control times of valve movements of the internal combustion engine are changed, for example, for improving the emission values, the fuel consumption, and the power profile. Such camshaft adjusters have a locking unit with a locking element, which produces a positive-fit connection between the driving element and the driven element in a locked operating position. In this way, in partial operating ranges of the internal combustion engine, for example, when the internal combustion engine is started or there is a drop in hydraulic pressure or there is a constant power demand, a set angle of the camshaft adjuster is fixed.

For example, due to times that the motor is stopped, it can occur that the camshaft adjuster is no longer completely filled with oil. After restarting the internal combustion engine, under some circumstances it takes a few seconds until the adjuster is completely filled with oil again. In this transition time, the absence of a locking unit can lead to control problems in the phase reference between the crankshaft and camshaft. This can cause worse exhaust-gas values and/or power values and can have negative effects on the service life and noise generation.

From the publication DE 197 55 497 A1, a camshaft adjuster with a vane-cell construction is known, in which the driving element is firmly connected to the driving wheel, while the driven element is connected rigidly to the camshaft. The driven element carries a piston, which is acted upon on one side by a spring and upon which a hydraulic force acts in the opposite direction. For a drop in hydraulic pressure below a threshold set by the spring, the spring moves the piston in the direction of the driving element, so that the piston enters into a corresponding recess of the driving element with a projection in the circumferential direction, forming a positive fit, which achieves a locking effect. The adjustment movement is here oriented in the axial direction of the camshaft adjuster.

From the publication DE 199 83 890 T1, a locking mechanism is known, with which a rotational movement of a driven element relative to a driving element can be limited. With this locking mechanism, a radial movement of a locking element takes place.

From the publication DE 197 24 989 A1, a construction of a camshaft adjuster is known, in which the driving element has external helical gearing and also the driven element has internal helical gearing and an adjustment element that can move axially depending on the action of a hydraulic force engages with the two helical gearings noted above for generating an adjustment movement. The driven element carries a spring-loaded hydraulic piston, which can move axially and which has radial gearing that can be brought into corresponding gearing of the driven element in the locked operating position in the axial direction.

In an alternative embodiment of publication DE 195 41 769, locking is realized not between the driving wheel and camshaft, but instead between the adjustment element noted above, which in this case forms the driven element in the sense of the invention, and driving element locked in rotation with the driving wheel. For this locking, the adjustment element has a projection, which can be displaced hydraulically in the radial direction and which can enter into a corresponding recess of the driving element.

From publication DE 196 23 818 A1, a camshaft adjuster with a vane-cell construction is known, in which a locking pin that can move axially, is spring loaded, and can be pressurized hydraulically in the axial direction into a vane formed with the driving element. In the locked operating position, the locking element constructed as a locking pin with a cone enters into a corresponding recess of the driven element in the axial direction. A guiding ring, which is to influence the guiding and sliding properties between the locking element and the driving element, is connected loosely between the driving element and the locking element.

Additional state of the art in terms of locking elements are known, for example, from publications DE 196 30 662 A1, DE 197 00 866 A1, DE 197 23 945 A1, DE 197 16 203 A1, DE 197 00 866 A1, DE 100 36 546 A1, DE 199 61 193 A1, DE 100 39 923 A1, DE 100 31 974 A1, and DE 100 55 334 C2.

From publication WO 03/076771 A1, it is known to produce components of the camshaft adjuster from a high load bearing, non-metallic material with at least one high load bearing plastic, by means of which advantages in terms of cost and energy are to be achieved. The high load bearing, non-metallic materials should be produced from one part or integrally for parts of the adjustment assembly, driving wheel, stator, covers, and sealing rings. Insert parts, such as screws, nuts, sleeves, and seals, and the like can be injection molded in the high load bearing plastic, wherein threading should also be cut or injected molded directly in the plastic.

SUMMARY

The invention is based on the objective of providing a camshaft adjuster, which is improved in terms of production costs,
weight,
material that is used,
mass moment of inertia,
(fatigue) strength,
transmission stiffness and/or
assembly.

The present invention is based on the knowledge that—for example, corresponding to the publication WO 03/076771 A1—the use of a plastic part for the driving element and/or the driven element is advantageous. However, according to the state of the art, such plastic parts are used exclusively for camshaft adjusters, which have no locking unit. Such known, non-lockable camshaft adjusters with plastic parts involve the preconception of those skilled in the art that the forces appearing in the region of a locking unit cannot be absorbed by a plastic part, because these could lead to cracks in the plastic part or failure of these parts, for example, due to excess large-area pressure forces or stresses. Here it must be taken into account that the plastic parts must feature the necessary mechanical properties in a wide temperature range. For a locking unit, a reduction of the appearing stresses and surface-area pressure forces is not possible or only with difficulty, in that the contact surfaces between the locking element and driving element or driven element are increased, because the locking unit and the locking element should have relatively small dimensions, so that a structurally compact camshaft adjuster is produced.

The solution forming the basis of the invention involves the use of at least one insert, which contacts the locking element with a positive fit in the locked operating position at least in one adjustment direction. Thus, for the insert, which forms the contact surface with the locking element, a suitable material is selectively chosen, for example, an iron, steel, aluminum, or a high-strength plastic. The insert can be prepared in the region of the named contact surfaces with suitable processing methods for the necessary stress. In this way, the insert can be optimally prepared for the contact and the transmission of the locking force between the locking element and the insert. In addition, in the region of an outer surface of the insert, the locking force is transmitted to the plastic part. Here, the outer surface of the insert can have an arbitrary shape, in order to guarantee an optimum transmission of the locking force. For example, the outer surface can be increased nearly arbitrarily, so that a contact surface between the insert and plastic part is increased. In addition, the contour of the outer surface can be shaped suitably for the transmission of the locking force.

The driving element according to the invention involves a component of the camshaft adjuster, whose movement correlates with the driving movement of the crankshaft of the internal combustion engine, while the movement of the driven element correlates with the movement of the camshaft of the internal combustion engine. Here, the driving and/or driven element can be connected rigidly to the driving wheel or the camshaft of the camshaft adjuster and thus can execute the same rotational angle movements like the driving wheel or the camshaft. Alternatively, the driving and/or driven element can be connected to the driving wheel or the camshaft by a geared connection with suitable step-up or step-down gearing. In the course of an adjustment movement of the camshaft adjuster, the relative angular position between the driving element and the driven element is changed.

In its locked operating position, the locking unit according to the invention can completely fix the driving and driven elements in both adjustment directions, can provide play, can implement fixing in only one adjustment direction, or else can represent a stop for limiting an adjustment movement.

According to another construction of the camshaft adjuster according to the invention, an improved connection and transmission of the locking force is produced if the insert has an enlarged extent in a direction of the locking force, wherein this can be a straight-line extension or an enlargement in a circumferential direction of the camshaft adjuster. In this way, the transmission length and also the transmission surface of the locking force can be increased without requiring a special installation space transverse to the locking force. For example, an enlarged extent is understood, in this sense, to be a length that is longer than the diameter or a transverse extent of the locking element or a dimension of a contact surface between the locking element and insert. The enlarged extent equals, in particular, at least two, three, or four times the transverse extent of the locking element or its diameter.

According to another aspect of the invention, the insert transmits the locking force at least partially frictionally engaged to the plastic part. A normal force for such a friction fit can be generated, for example, by pressing the insert into the plastic part, especially under radial compression, by means of cross-sectional expansion due to the resulting locking force, an elastic deformation of the insert or plastic part for inserting the insert into the plastic part and/or a movement of the camshaft adjuster. It is similarly conceivable that the insert will be tensioned against the plastic part by a tensioning or fastening element, such as, for example, the central screw for producing a connection of the camshaft adjuster with the camshaft, by means of which the normal force of the friction fit is given. Such a friction fit has advantages, for example, for mounting, because the locking position can be fine adjusted during mounting.

Alternatively or additionally, it is possible that the insert transmits the locking force at least partially frictionally engaged to the plastic part. Through such a positive-fit connection, initially the relative position of the insert relative to the plastic part can be given by the structure, wherein the need for fine adjustments during mounting can be avoided. Furthermore, a positive-fit transfer of the locking force between the insert and the plastic part guarantees an especially rigid, under some circumstances, play-free and reliable transmission of the locking force.

The insert can be connected detachably to the plastic part to form a driving or driven element. An integral driving or driven element can be formed, such that the insert and the plastic part are connected to each other by a non-positive fit. The non-positive fit can be provided in the form of an adhesive. Alternatively, the plastic part can be sprayed onto the insert, through which an economical and simple production method is given with simultaneously good connection between the insert and plastic part.

Preferably, the insert has external gearing, projections, ribs, or recesses, which engage with a positive fit in corresponding counter gearing, projections, ribs, or recesses of the plastic part. In this way, force-transmission surfaces are created, which are preferably oriented perpendicular to a direction of the locking force, and guarantee good force transmission with low surface-area pressure forces. For the case that the insert has a large extent in the direction of the locking force or circumferential direction, for a compact construction, several teeth of the gearing, projections, ribs, or recesses can be arranged one behind the other in the direction of the locking force.

Furthermore, it can be advantageous when the insert extends over a circumferential angle of 50° to 300°. In this way, the active surface areas of positive-fit connections can be further enlarged and/or the surface of friction-fit contacts can be extended over the circumferential angle. For such large circumferential angles and a construction of the insert and the plastic part with corresponding gearing, in principle the gearing of the insert at first contacts the corresponding counter gearing of the plastic part only in the region of one tooth or a few teeth due to the finite production accuracy. In this respect, the invention is based on the knowledge that plastic has a relatively low modulus of elasticity, so that the number of contacting teeth increases with also only a small locking force, so that the force is distributed over a large contact surface and many teeth, by means of which the life expectancy of the gearing made from plastic can be significantly increased. For a construction of a friction-fit connection between the insert and plastic part, the transferable friction force can be increased significantly according to the measure of the wrap-around angle and the elastic deformation of the insert.

According to one special proposal of the invention, the insert is constructed as a circular-ring disk, which, on its own, already represents a rigid, closed ring structure. The circular-ring disk has an axial or radial projection, gearing or the like, or a recess, which interacts with a positive fit at least in one circumferential direction with a projection or a corresponding recess of the plastic part. The positive-fit connection first sets the mounting of the insert relative to the plastic part, so that incorrect mounting is excluded. Furthermore, through the contact between the projection and recess, a reliable transmission of the locking force is guaranteed. This construction also comprises a non-round outer geometry of the circular-ring, disk-shaped insert, which can be inserted into a corresponding inner geometry of the plastic part.

The plastic can involve, for example, a duroplastic. However, the use of other kinds of plastic is also conceivable.

BRIEF DESCRIPTION OF THE DRAWINGS

Additional features of the invention emerge from the following description and the associated drawings, in which embodiments of the invention are shown schematically. Shown are.

DETAILED DESCRIPTION OF THE PREFERRED EMBODIMENTS

Figure 1:
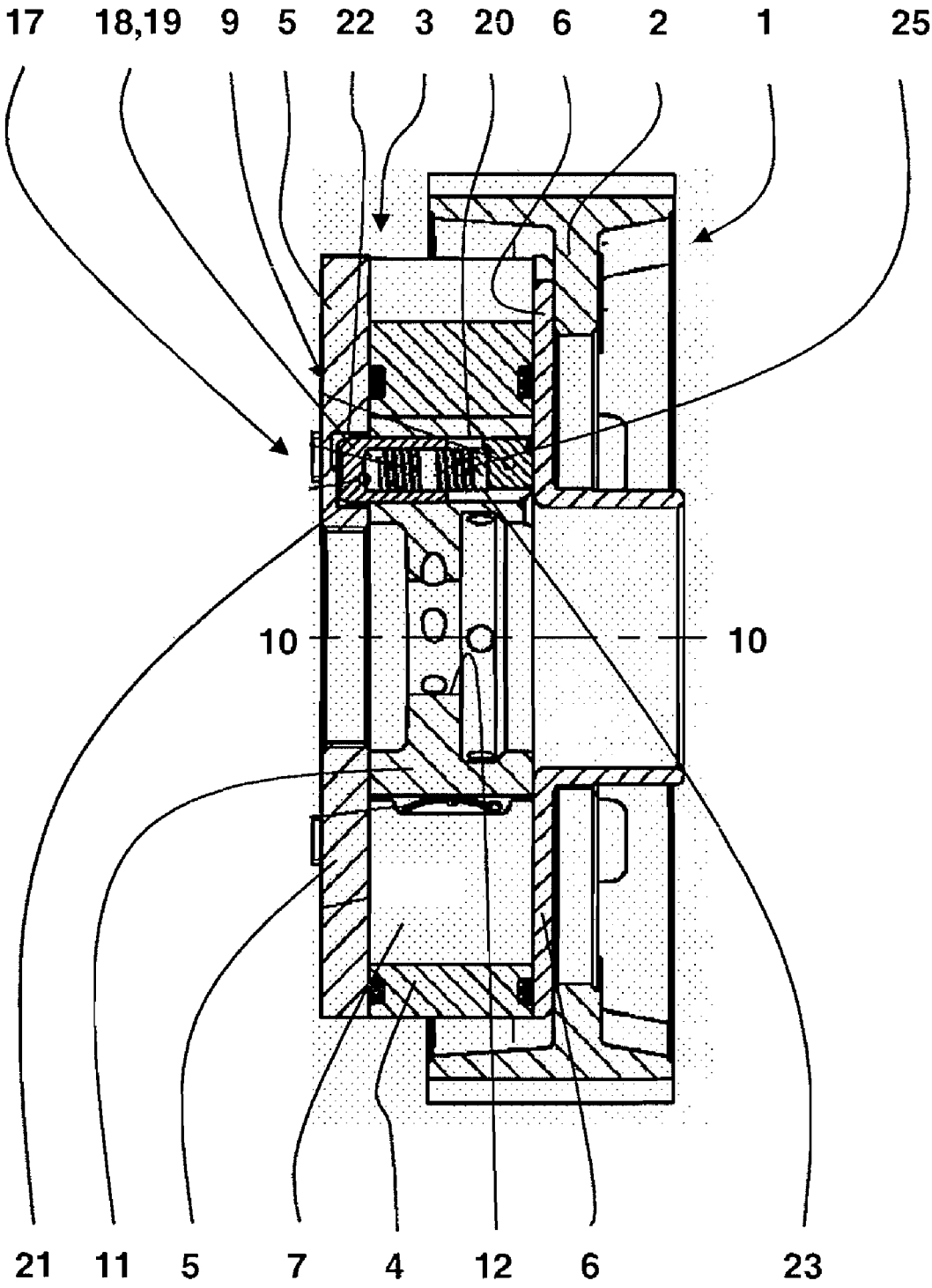
FIG. 1 a camshaft adjuster according to the state of the art in a longitudinal section view.

The invention relates to a camshaft adjuster in any construction, for example, with a vane-cell construction, axial-piston construction, or with a triple-shaft gear mechanism or an eccentric gear mechanism, wherein the adjustment movement is preferably performed on the basis of a hydraulic adjustment assembly or an electric adjustment assembly. In the figures, a camshaft adjuster with a vane-cell construction is shown merely as an example.

A camshaft adjuster 1 has a driving wheel 2, which is in driven connection with a crankshaft of an internal combustion engine by a traction element. A housing 3 of the camshaft adjuster 1 is connected rigidly to the driving wheel 2 and essentially has a U-shaped half cross section with a base leg 4, which forms a casing surface closed radially outwardly and also two parallel side legs 5, 6 extending radially inwardly from the base leg 4. Chambers 7, which are defined in the circumferential direction by projections or vanes 8 of the housing 3 projecting radially inwardly, are formed in the housing 3 with the U-shaped half cross section and radially outwardly by the base leg 4 and in the axial direction 10-10 by the side legs 5, 6. The side leg 5 or the housing 3 with the driving wheel 2 connected rigidly to this housing forms a driving element 9.

A driven element 11 is supported in the housing 3 so that it can rotate about a longitudinal axis 10-10 to a limited extent relative to the driving element 9. The driven element 11 is connected to a camshaft, which is allocated to intake and/or exhaust valves, through a central borehole 12 oriented in the axial direction. The driven element 11 has a cylindrical body 13, from which vanes 14 extend radially outward into the chambers 7. In the circumferential direction on both sides of the vane 14, pressure chambers 15, 16 are formed, which are each allocated to different adjustment directions of the camshaft adjuster. The pressure chambers 15, 16 are closed in the axial direction by the side legs 5, 6 and in the cross section shown in FIG. 2 by the inner surface of the housing, which is formed with the base leg 4, the outer casing surface of the body 13, the vane 14, and also the vane 8. The volume of the pressure chambers 15, 16 is variable in the course of the adjustment movement of the camshaft adjuster 1, in that the distance of the vanes 8, 14 changes in the circumferential direction.

FIG. 1 shows a locking unit 17, which locks or fixes the relative rotational angle position between the driving element 9 and driven element 11 about the longitudinal axis 10-10 in the shown locked operating position. For this purpose, the locking unit 17 has a locking element 18, which is constructed in the present case as a pin 19. The pin 19 can move along an axis, which is oriented parallel to the longitudinal axis 10-10, guided in a borehole 20 of the driven element 11. While the pin is arranged completely in the driven element in the unlocked operating position of the locking unit 17, in the locked operating position shown in FIG. 1, the pin 19 is moved in the axial direction out of the driven element 11, so that this extends with a front region 21 into a corresponding blind borehole 22 of the driving element 9, especially the side leg 5. The borehole 20 is closed in the end region opposite the blind borehole 22. The pin 19 has a central borehole 23, which extends from the end of the pin 19 opposite the blind borehole 22 centrally into this borehole.

A pressure chamber 16 is connected hydraulically to the end face of the front region 21 of the pin 19 via a hydraulic connection 24, so that a hydraulic pressure in the pressure chamber 16 forces the pin 19 in the direction of the unlocked operating position. A compression spring 25, which is supported on the pin 19 in one end region and on the base of the borehole 20 in the opposite end region, extends into the blind borehole 23 of the pin 19. For a drop in pressure in the pressure chamber 16 and thus of the hydraulic connection and also in the region of the end face of the front region 21, the compression spring 25 forces the pin 19 in the direction of the locked operating position, in which the pin 19 enters into the blind borehole 22.

Additional details on the principle function of a camshaft adjuster 1 are to be taken from the publication WO 01/02703 A1 by the applicant.

Figure 2:
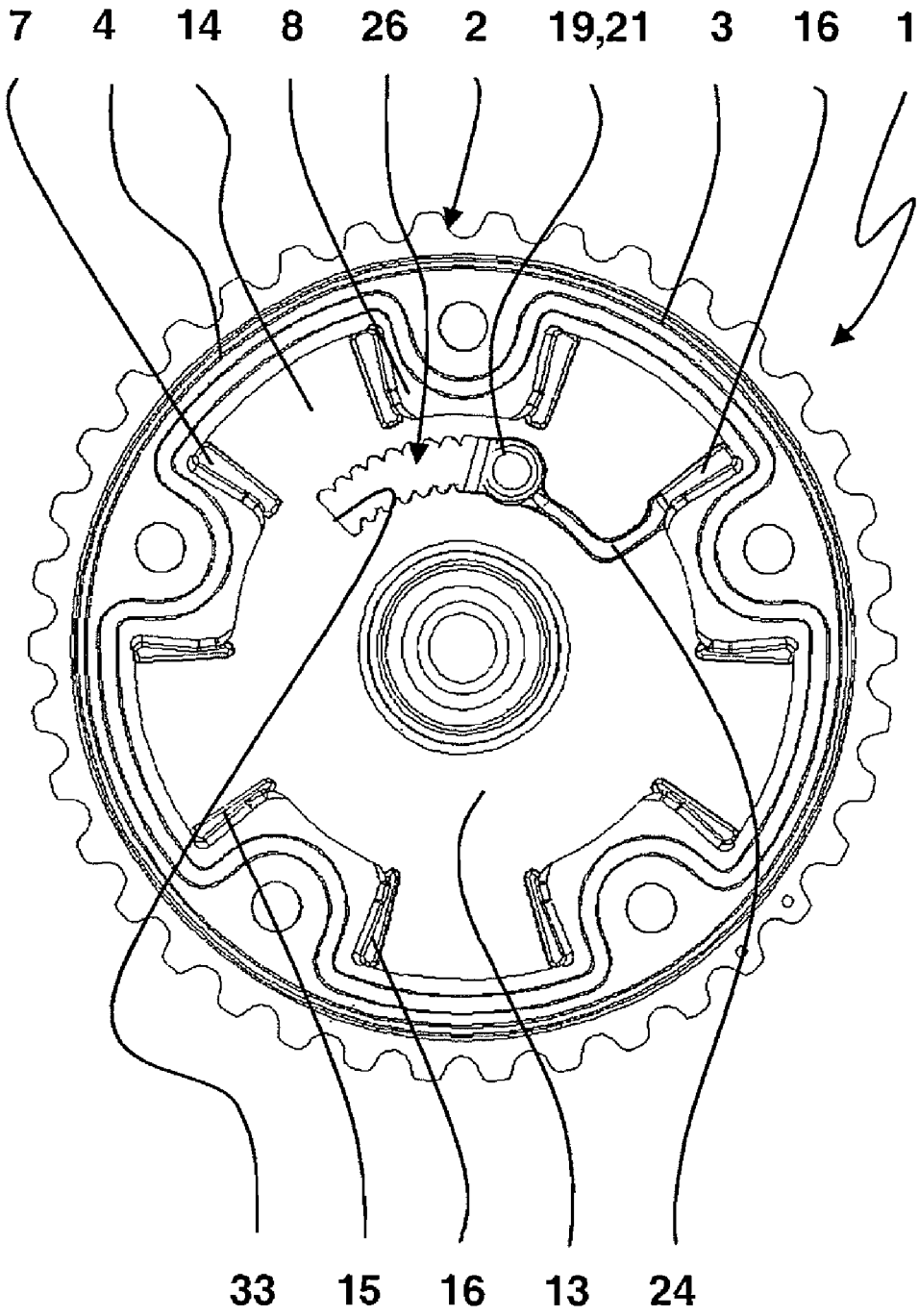
FIG. 2 a camshaft adjuster according to the invention with an insert in a cross-sectional view.
Figure 3:
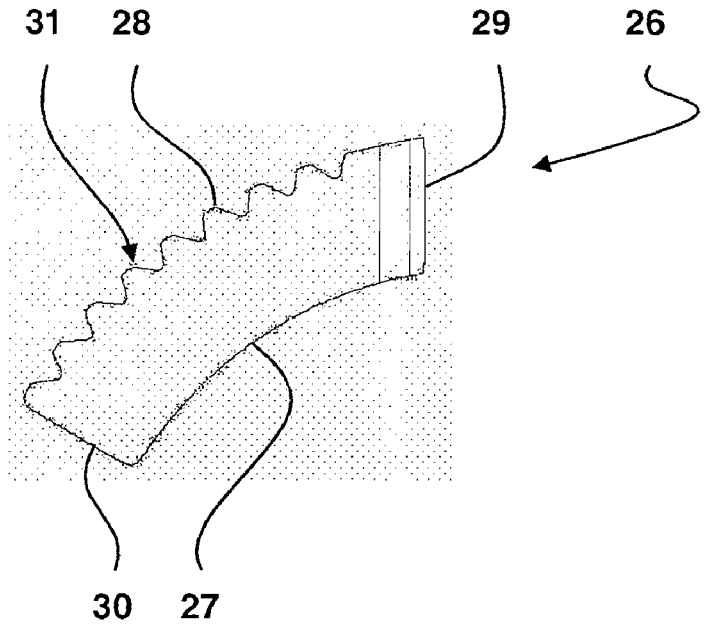
FIG. 3 a view of the insert of the camshaft adjuster according to FIG. 2.

According to FIG. 2, an insert 26 is arranged or introduced or inserted in the driving element 9, which is shown in detail in FIG. 3.

The insert 26 has an approximately circular ring segment-shaped geometry with circular segment-shaped or partial cylinder-shaped inner contour 27, concentric partial circular-shaped or partial cylinder-shaped outer contour 28, and also end faces 29, 30 oriented radially or perpendicular to the contours 27, 28. The outer contour 28 is provided with gearing 31, which is here provided with teeth with an arbitrary, known tooth geometry, here trapezoidal teeth. The insert 26 is inserted in the viewing direction according to FIG. 2 into the driven element 11 and extends in the circumferential direction about the longitudinal axis 10-10. For such insertion, the driven element 11 has a recess 33, whose cross section is constructed corresponding to the inner contour 27, outer contour 28, and end face 30. The gearing 31 is engaged with corresponding gearing of the driven element 11.

In the circumferential direction, the locking element 18 is supported on the end face 29 of the insert 26, wherein the casing surface of the front region 21 of the pin 19 contacts the end face 30.

Deviating from the embodiment of the insert 26 according to FIG. 3, the end face 29 can be formed, for example, curved, with the front region 21 corresponding to the locking element for increasing the contact surface area. Alternatively, the insert can provide in the region of the end face a borehole vertical to the plane of the drawing according to FIG. 3, so that an "eye" is formed, in which the pin 19 enters, so that the borehole completely surrounds the pin 19 and provides a contact surface in several directions. The insert 26 is arranged in the circumferential direction opposite the hydraulic connection 24.

Figure 4:
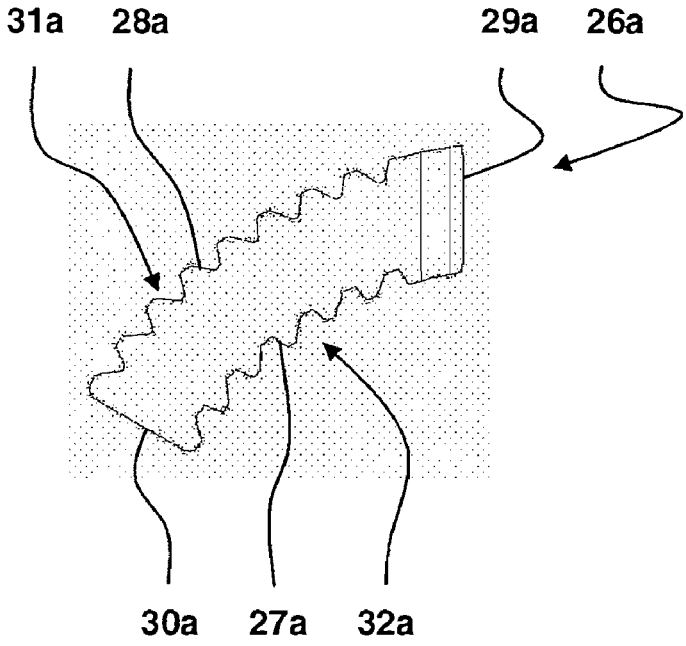
FIG. 4 a view showing an alternative construction of an insert for a camshaft adjuster according to the invention.

FIG. 4 shows an alternative construction of the insert 26*a*, for which the inner contour 27 are also provided with gearing 32, which can engage with suitable counter gearing of the driven element 11. For the embodiments shown in FIGS. 3 and 4, the insert 26, 26*a* extends over a circumferential angle of between 45° and 90°, especially between 50° and 70°.

Figure 5:
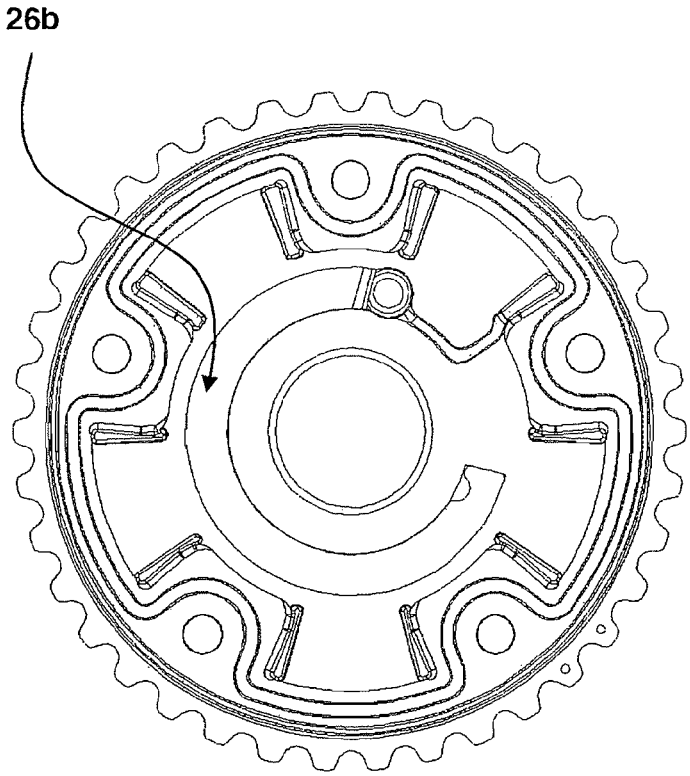
FIG. 5 a view of a camshaft adjuster with another embodiment of an insert, which extends past a circumferential angle of approximately 270°.
Figure 6:
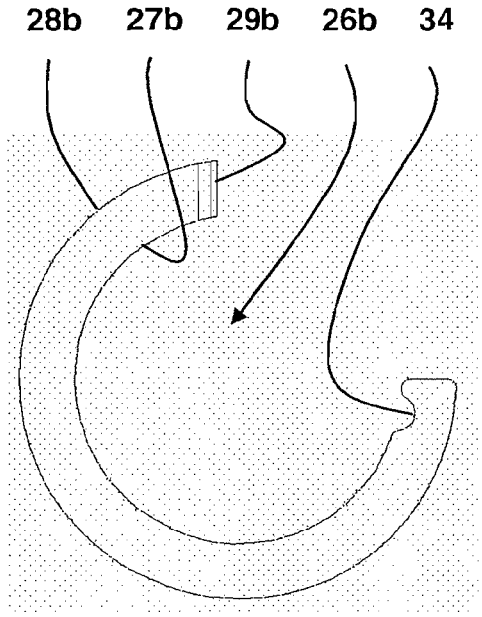
FIG. 6 a view of the insert of the camshaft adjuster according to FIG. 5.

An alternative construction of the insert 26*b* is shown in FIGS. 5 and 6. The insert 26*b* extends in this case over a circumferential angle of approximately 270°. Such an insert 26*b* can also provide gearing 31*b*, 32*b* in the region of the inner and/or outer contours 27*b*, 28*b*. In FIGS. 5 and 6, however, an insert 26*b* is formed without such gearing. In the end region opposite the end face 29*b*, the insert 26*b* has in the region of the inner contour 27*b* a radial recess 34, in which a corresponding projection of the driven element 11 enters, in order to secure the insert 26*b* against displacement in the circumferential direction. If the insert 26*b* is pressurized with a locking force by the pin 19, then for an elastic construction of the insert 26*b* and/or the driven element 11, the insert 26*b* can contact the border of the recess 33 in the region of the outer contour 28*b* and/or in the region of the inner contour 27*b*, whereby the securing of the insert 26 through resulting friction forces is supported.

Figure 7:
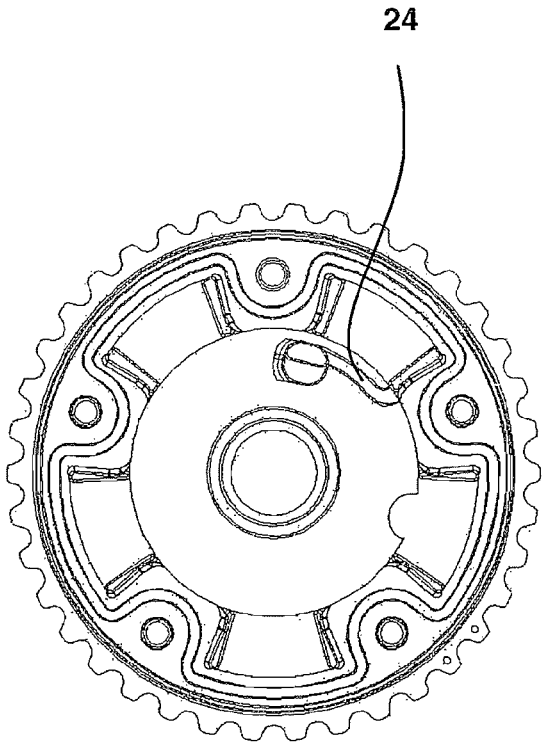
FIG. 7 a camshaft adjuster with a circular-ring disk-shaped insert in a cross-sectional view.
Figure 8:
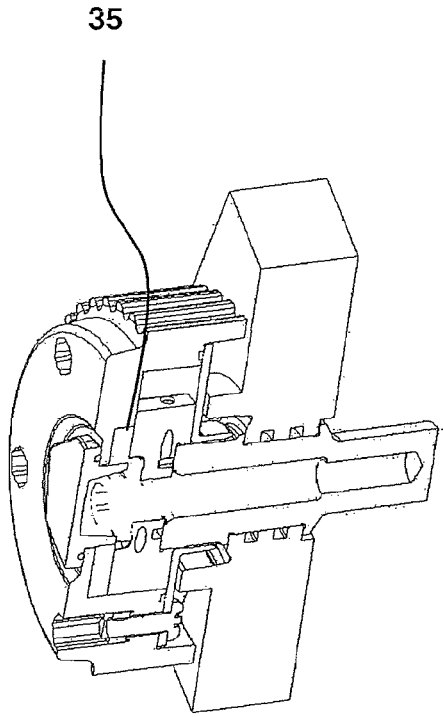
FIG. 8 the camshaft adjuster according to FIG. 7 in half section in a perspective view.
Figure 9:
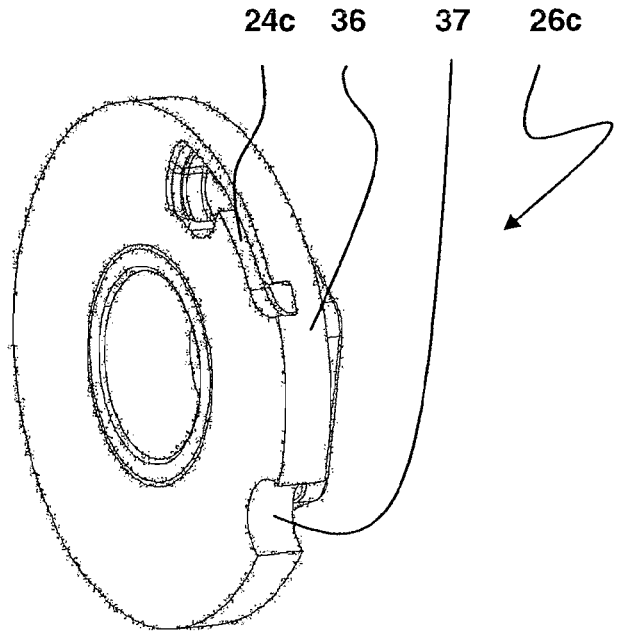
FIG. 9 the circular ring disk-shaped insert according to FIGS. 7 and 8 in perspective view.

FIGS. 7 to 9 show an insert 26*c*, which is formed essentially in the form of a circular ring disk with an approximately rectangular half cross section 35. In this case, the insert 26*c* has the hydraulic connection 24*c*, which opens into the pressure chamber 16 and pressurizes the pin 19 in the opposite end region. The insert 26*c* completely surrounds the front region 21 of the pin 19 in the locked operating position. Furthermore, the insert 26*c* can have a recess or indentation 37, which engages in a corresponding tab of the driven element 11 for rotationally locking the insert 26*c* and/or for guaranteeing error-free mounting of the insert 26*c*, in the region of the outer casing surface 36.

Figure 10:
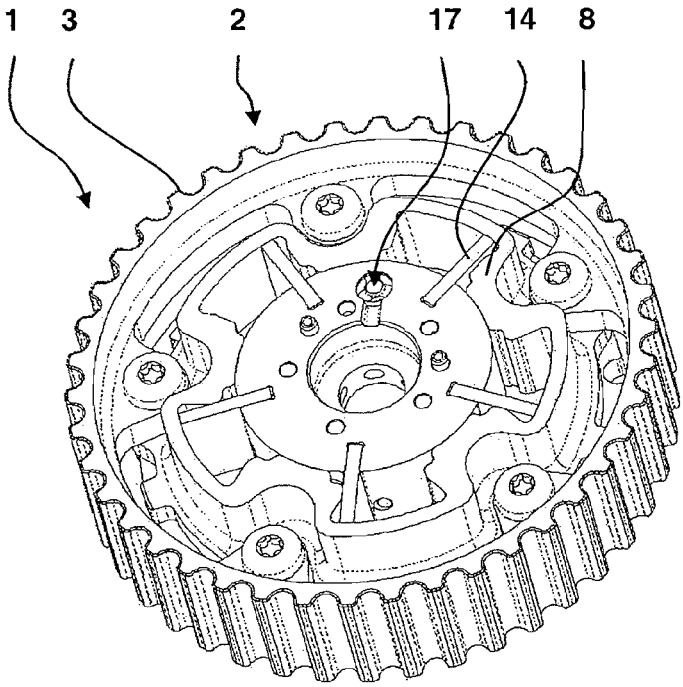
FIG. 10 a sectioned camshaft adjuster in perspective view.
Figure 11:
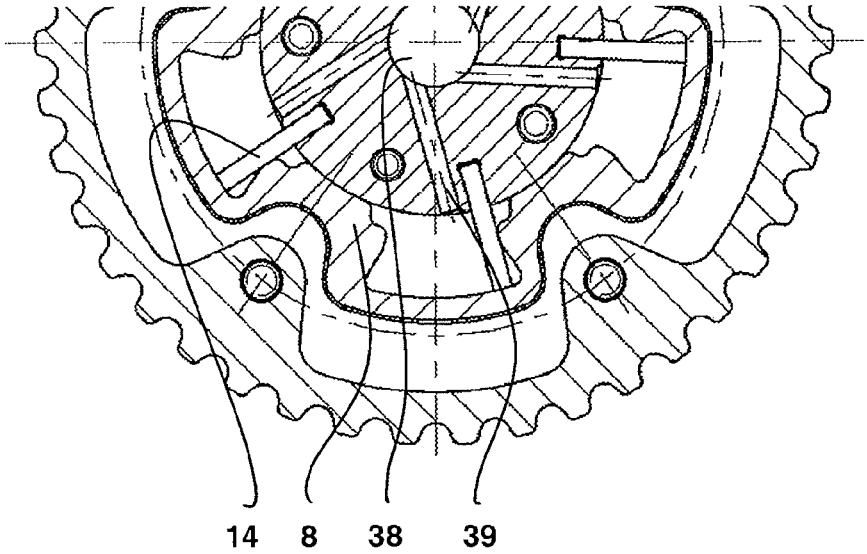
FIG. 11 the camshaft adjuster according to FIG. 10 in a half cross-sectional view.

FIGS. 10 and 11 show the pressurization of the pin 19 with a hydraulic medium via a central borehole 38 of the camshaft adjuster 1 and a radially oriented side channel 39, which connects the borehole 38 hydraulically to the end face of the pin 19.

According to the embodiment shown in FIG. 1, the side leg 5, which forms the driving element 9, is not formed integrally with additional components of the housing 3, but instead it is constructed as a kind of sealing cover, which in the present case is made of plastic and which holds the insert 26. The driven element 11 preferably involves a component made from metal. The use of a material, which has a lower coefficient of expansion than the plastic that is used, is preferred. Though such a material, especially for a plastic unit consisting of a driving wheel, a stator, and a cover in the form of the side leg 5, favorable compressive internal stresses at higher operating temperatures in the transition region between the stator and cover are obtained. This is important because plastics permit only very low tensile stresses in comparison to the compression strength, especially for the use of a duroplastic. In this way, different, apparently different coefficients of expansion can be used.

Alternatively or additionally, the compressive internal stresses can be generated by tensioning of the components during the mounting.

The insert preferably is a steel part, a sintered part, a hardmetal part, or a ceramic part. For the case that the insert is constructed as a circular ring disk, it is possible that this is tightened onto the plastic part via the central screw of the camshaft adjuster or via a different connection element, such as a screw. This application is suitable for high stresses and uses the contact surface and the coefficient of friction between the plastic and insert for uniform load introduction of the locking element. The power capacity of this combination is reinforced by the joint between the closing screw and the connecting element and insert, in which the plastic lies as a sandwich between the two friction partners.

LIST OF REFERENCE NUMBERS

1 Camshaft adjuster
2 Driving wheel
3 Housing
4 Base leg
5 Side leg
6 Side leg
7 Chamber
8 Vane
9 Driving element
10 Longitudinal axis
11 Driven element
12 Borehole
13 Body
14 Vane
15 Pressure chamber
16 Pressure chamber
17 Locking unit
18 Locking element
19 Pin
20 Borehole
21 Front region
22 Blind borehole
23 Blind borehole
24 Hydraulic connection
25 Compression spring
26 Insert
27 Inner contour
28 Outer contour
29 End face
30 End face
31 Gearing
32 Gearing
33 Recess of driven element
34 Recess of insert
35 Half cross section
36 Casing surface
37 Recess
38 Borehole
39 Side channel

The invention claimed is:

1. A camshaft adjuster for an internal combustion engine comprising a locking unit, which, in a locked operating position, fixes an adjustment angle of the camshaft adjuster, such that a locking element creates, at least in one adjustment direction, a positive-fit connection between a driving element, which is in driven connection with a crankshaft of the internal combustion engine, and a driven element, which is in driving connection with a camshaft of the internal combustion engine, at least one of the driving element or the driven element is formed with a plastic part and has an insert located in a comulementary opening therein, which contacts the locking element in the locked operating position at least in one adjustment direction, the insert has an outer surface that transmits a locking force to a surrounding area of the plastic part, and the insert has an enlarged extent in a circumferential direction from a contact point of the locking element in a direction of the locking force.

2. The camshaft adjuster according to claim 1, wherein the insert transmits the locking force to the plastic part at least partially by a positive fit.

3. The camshaft adjuster according to claim 1, wherein the insert transmits the locking force to the plastic part at least partially by a positive fit.

4. The camshaft adjuster according to claim 1, wherein the insert and the plastic part are connected to each other with a non-positive fit.

5. The camshaft adjuster according to claim 1, wherein the insert has at least one of outer gearing, projections, ribs, or recesses, which engage with a positive fit in corresponding counter gearing, projections, ribs, or recesses of the plastic part.

6. The camshaft adjuster according to claim 1, wherein the insert extends over a circumferential angle between 50° and 300°.

7. The camshaft adjuster according to claim 1, wherein the insert is constructed as a circular ring disk with a projection or a recess, which interacts with a positive fit with a projection or a recess of the plastic part in at least one circumferential direction.

8. A camshaft adjuster for an internal combustion engine comprising a locking unit, which, in a locked operating position, fixes an adjustment angle of the camshaft adjuster, such that a locking element creates, at least in one adjustment direction, a positive-fit connection between a driving element, which is in driven connection with a crankshaft of the internal combustion engine, and a driven element, which is in driving connection with a camshaft of the internal combustion engine, at least one of the driving element or the driven element is formed with a plastic part and has an insert located in a complementary opening therein, which contacts the locking element in the locked operating position at least in one adjustment direction, the insert extends asymmetrically from a contact point of the locking element in a direction of the locking force, the insert has an outer surface that transmits a locking force to the plastic part, the insert has gearing comprising at least three teeth, projections, ribs, or recesses, which engage with a positive fit in the complementary opening in the plastic part.

9. A camshaft adjuster for an internal combustion engine comprising a locking unit, which, in a locked operating position, fixes an adjustment angle of the camshaft adjuster, such that a locking element extends from a housing in a driven element, which creates, at least in one adjustment direction, a positive-fit connection between a driving element, which is in driven connection with a crankshaft of the internal combustion engine, and the driven element, which is in driving connection with a camshaft of the internal combustion engine, the driving element is formed with a plastic part and has an insert located in a complementary opening therein, which contacts the locking element in the locked operating position at least in one adjustment direction, the insert extends asymmetrically from a contact point of the locking element in a direction of the locking force, the insert has an outer surface that transmits a locking force to the plastic part, the insert has an enlarged extent in a circumferential direction from a contact point of the locking element in a direction of the locking force, that is longer than a diameter or transverse extent of the locking element in the circumferential direction.

* * * * *